United States Patent [19]

Kriegner et al.

[11] Patent Number: 4,687,141

[45] Date of Patent: Aug. 18, 1987

[54] JET NOZZLE

[75] Inventors: Othmar Kriegner, St. Valentin; Franz Lang, Linz; Günter Holleis, Linz; Karl Schwaha, Linz; Fritz Gränitz, Linz, all of Austria

[73] Assignee: Voest-Alpine International Corporation, New York, N.Y.

[21] Appl. No.: 630,592

[22] Filed: Jul. 13, 1984

[30] Foreign Application Priority Data

Jul. 26, 1983 [AT] Austria ..... 2718/83

[51] Int. Cl.[4] ..... B05B 1/26; B22D 11/124

[52] U.S. Cl. ..... 239/520; 164/444

[58] Field of Search ..... 239/1, 11, 52–524, 239/529; 164/442, 444

[56] References Cited

U.S. PATENT DOCUMENTS

| | | | |
|---|---|---|---|
| 1,536,230 | 5/1925 | McCue | 239/521 |
| 2,530,671 | 11/1950 | Wahlin | 239/523 |
| 2,918,220 | 12/1959 | Crow | 239/521 |
| 2,921,488 | 1/1960 | Davis | 239/523 |
| 3,989,093 | 11/1976 | Peitl | 164/444 |
| 4,130,247 | 12/1968 | Healy | 239/523 |
| 4,219,161 | 8/1980 | Freissle | 239/523 |
| 4,320,072 | 3/1982 | Arndt | 261/111 |
| 4,411,534 | 10/1983 | Kriegner et al. | 374/141 |
| 4,509,582 | 4/1985 | Kriegner | 164/486 |
| 4,541,564 | 9/1985 | Berger et al. | 239/520 |

FOREIGN PATENT DOCUMENTS 327418 1/1974 Austria .

OTHER PUBLICATIONS

"Design of Strand Guide Rollers, Full-Face Rollers and Intermediately Supported Rollers", by Holleis, Voest-Alpine Continuous Casting Conference 1984.

"Automation of Continuous Casters: Practical Experiences with New Devices", by Gidl et al., Voest-Alpine Continuous Casting Conference 1984.

"Experience with Use of Width Adjustable Mould", by Bastner et al., Voest-Alpine Continuous Casting Conference 1981.

"Analysis of Electromagnetic Stirring and Continuous Casting-Turbulent Flow and Heat Transfer Calculations", Bauer et al., Voest-Alpine Continuous Casting Conf. 1981.

"Theoretical and Experimental Investigation on Strand Mechanics and Strand Cooling", Angerer et al., Voest-Alpine Continuous Casting Conference 1984.

*Primary Examiner*—Andres Kashnikow
*Assistant Examiner*—Kevin P. Weldon
*Attorney, Agent, or Firm*—Horst M. Kasper

[57] ABSTRACT

The jet exiting from jet nozzles is guided along a guide surface for a jet nozzle with one or more nozzle channels disposed next to each other and in parallel, where the hydraulic diameter of the nozzle channels is from about 1.5 to 4 millimeters. In order to limit sharply and without spray the jet exiting out of the jet nozzle crosswise to its axis on the sides and in order to maintain it of uniform width over a large part of its length, the guide surface is of concave shape, the nozzle channels merge without step into the cylindrical jacket surface, the axes of the nozzle channels and the guide surface include an angle of from 0.5 and 2.5 degrees, and the guide surface is provided with a tear-off provision with a cutting edge.

13 Claims, 4 Drawing Figures

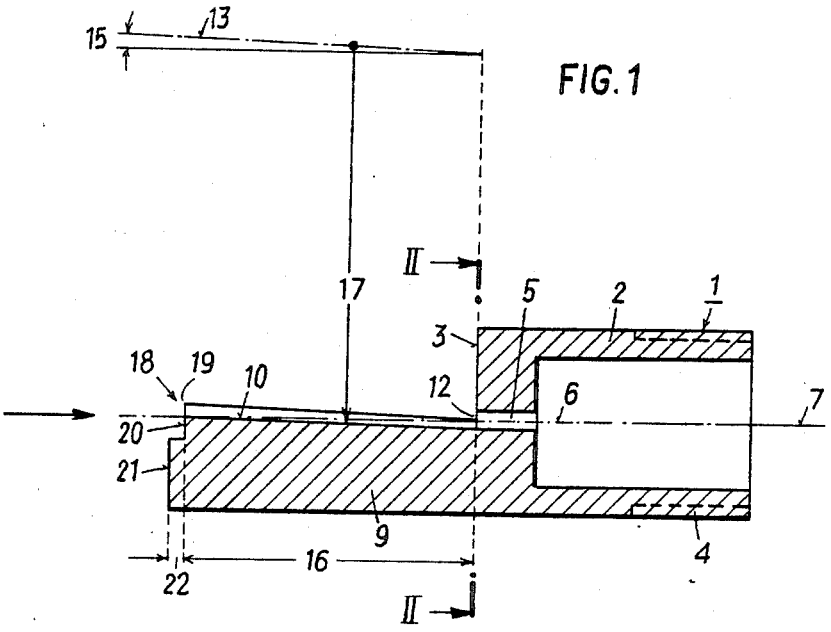
FIG. 1
FIG. 2
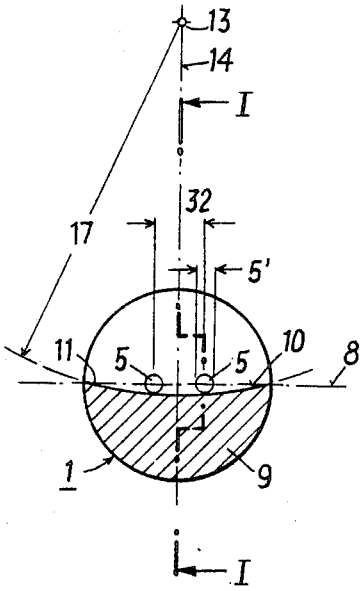
FIG. 3
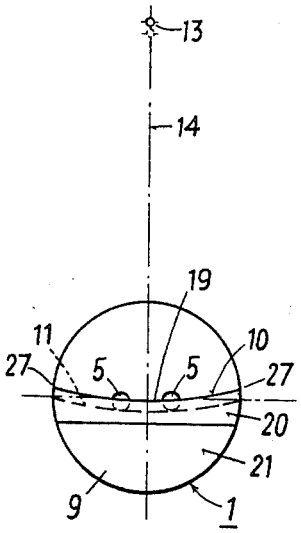

JET NOZZLE

BACKGROUND OF THE INVENTION

1. Field of the Invention

The present invention relates to a jet nozzle for the cooling operations employed in continuous casting plants and in particular for the cooling of the support and guide rollers with liquid or liquid-gas jets, where two or more jet channels are disposed next to each other, where the axes are parallel with respect to each other, where the hydraulic diameter of the nozzle channels is in the area of about 1.5 to 4 millimeter, and where the jet exiting out of the nozzle channels is guided by a guide surface.

2. Brief Description of the Background of the Invention Including Prior Art

A nozzle of the general kind recited above is known from the Austrian Patent AU-PS No. 327,418. This jet nozzle serves primarily for the the cooling of a strand and/or of support and guide rollers in a continuous casting plant.

There is the desire to cast with continuous casting plants strands over a width region which is as large as possible. For example, it is already possible to cast slabs with a width of 2.5 meters. In the case of billet or respectively bloom continuous casting plants the desire is in the direction of being able to cast several strands with billet or, respectively, bloom cross-section, which are neighboring together as close as possible. For example it is the use with a slab cross-section continuous casting plant to cast simultaneously several strands with bloom cross-section instead of the slab cross-section.

It is desirable in the case of plants of this kind to avoid the direct spraying of the closely spaced neighboring strands. In contrast the cooling medium is intended to primarily to pick up the radiation heat of the strand. A particular problem is posed by the edge spraying of the edges of the strand with cooling agent, which is to be avoided if possible, since otherwise the product quality is lowered and a waste disposal of the strand or, respectively, the strands may become necessary. In case of a simultaneous casting of several strands with bloom cross-section at a slab continuous casting plant it is very difficult, to guide the billets on a side, such that a side spraying with cooling agent can result in a sideways migration of a strand.

In case the cooling agent is primarily sprayed against the support and guide rollers, then the problem results that in case of continuous casting plants, which are constructed for the continuous casting of vary wide slabs, that at the more than once over their length supported roller where the jacket is interrupted, cooling agent is sprayed to the faces directed vertically to the axes and is guided from there to the strand.

At plants of usual construction with rollers supported at several points of their length, it was hitherto not possible to avoid that a large percentage of the cooling agent in this manner passed to the strand surface, which was a disadvantage for the quality of the strand or, respectively, the further processing (hot processing or direct use in a rolling mill).

SUMMARY OF THE INVENTION

1. Purposes of the Invention

It is an object of the present invention to provide a jet nozzle where the jet squirting out of the nozzle has a small cross-section and is crosswise firmly limited relative to its axis on the side without any spraying.

It is another object of the invention to keep the jet of equal width over a large part of its length such that closely neighboring strand guide rollers are not affected in the region, which is shielded by the cooling agent jet against the surface of the strand and which are not hit directly, if possible, by the cooling agent itself.

It is a further object of the present invention to avoid a sidewise wandering of a billet based on an edge cooling, since in case of simultaneously casting of several strands with bloom cross-section it is very difficult to guide the blooms on their sides.

These and other objects and advantages of the present invention will become evident from the description which follows.

2. Brief Description of the Invention

According to one aspect, the present invention provides a jet nozzle for the cooling of continuous casting plants with fluid jets which comprises a jet nozzle body having at least two next to each other disposed nozzle channels with parallel axes and the hydraulic diameter of the nozzle channels can range from about 1.5 to 4 millimeters, a concave guide surface for guiding the jet exiting from the nozzles with the nozzles merging stepless into the guide surface and where the axes of the nozzle channels and the guide surface include an angle of from about 0.5 to 5 degrees, and a break provision with a cutting edge disposed at the guide surface.

The guide surface can be formed as a cylinder jacket surface outside of the jet nozzle body and is disposed in a plane located near the axis of the jet nozzle body. The guide surface can be formed as a cylinder jacket surface outside of the jet nozzle body and includes an angle of from about 0.5 to 2.5 degrees with the axis of the jet nozzle body. The radius of the cylinder jacket surface can be from about 30 to 80 millimeters. The radius of the cylinder jacket can be from about 40 to 60 millimeters. The cutting edge can be disposed in a plane located about vertical relative to the axes of the nozzle channels. The projection of the cutting edge can cut the nozzle channels in the direction of the axes of the nozzle channels.

The ratio of the length of the cylinder jacket surface to the radius of the cylinder jacket surface can be in the range of from about 0.3 and 1.3, where the length of the cylinder jacket surface amounts to from about 40 to 60 millimeters. The ratio of the axial distance of the axes of the two nozzle channels having furthest distance from each other to the radius of the cylinder jacket surface can be in the range of from about 0.15 to 0.23. The end of the guide plane providing the cutting edge can be recessed relative to the jet nozzle body in the direction of its axis by a distance.

The jet nozzle with its longitudinal axis can be directed in parallel with the axes of the rollers and is further disposed at a distance above the strand surface, that is the connection plane of the jacket surfaces. The guide surface can be directed away from the connection plane of the jacket surfaces of two neighboring rollers. The tangential lines placed at the guide face and disposed in a plane vertical to the axes of the rollers preferably are directed toward the axes of the rollers. The diameter of the jet nozzle body can be from about 5 to 20 times the diameter of a nozzle channel. The radius of the cylinder jacket surface can be from about 5 to 20 times the radius of the jet nozzle body.

According to another aspect of the present invention there is provided a method for jet cooling of continuous casting plants with fluid jets which comprises channelling a fluid through a nozzle, guiding the output of the nozzle over a curved surface intersecting the nozzle axis with the nozzle merging into the curved surface without a step, and releasing the flow from the curved surface with a cutting provision.

Part of the output of the nozzle can move above the surface level of the cylindrical jacket surface. The cylindrical jacket surface can be disposed such that the tangentially leaving squirts of fluid impinge about vertically onto a surface to be cooled. The jet nozzles can be disposed with the nozzle axis about parallel to the axis of two parallel cooling rollers and about at the mirror plane of the parallel rollers and where the axis of the nozzles is from about 0.3 to 0.7 of the radius of the rollers removed from the plane spanned by the roller axes and where the fluid squirts from the cylindrical jacket surface in a tangential direction toward the axes of the two respective rollers. The cutting provision releasing the fluid from accidental damage can be protected by a protrusion.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OP THE DRAWING

In the accompanying drawing, in which are shown several of the various possible embodiments of the present invention:

FIG. 1 is a longitudinal sectional view through a jet nozzle,

FIG. 2 is a cross-section along section line II—II of FIG. 1,

FIG. 3 is a view of the jet nozzle in the direction of the arrow III of FIG. 1.

DESCRIPTION OF INVENTION AND PREPERRED EMBODIMENT

Figure 4:
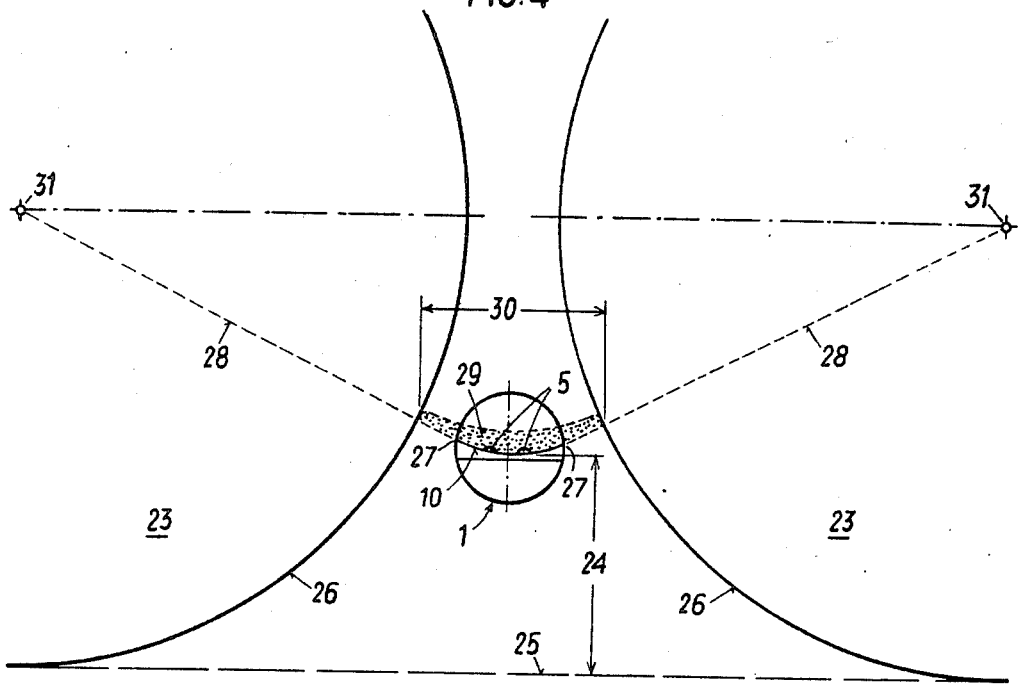
FIG. 4 is a view of the jet nozzle mounted between two strand guiding rollers of a continuous casting plant in asectional view similar to that of FIG. 3 and including a cross-section through the squirt of the cooling agent.

In accordance with the present invention there is provided a jet nozzle 1 for cooling to be employed in continuous casting plants, in particular for the cooling of support and guide rollers 23 with liquid or liquid-gas jets, including two or more nozzle channels 5 disposed next to each other in a jet nozzle body and having their axes disposed about in parallel. The hydraulic diameter of the nozzle channels is in the area of 1.5 to 4 millimeter and the jet exiting from the nozzle channels 5 is guided at a guide surface 10. The guide surface 10 is of a concave curvature and the nozzle channels 5 merge stepless into the guide surface 10. The axes 6 of the nozzle channels 5 include an angle 15 of from about 0.5 to 5 degrees with the guide surface. The guide surface 10 is provided with a break provision 18 incorporating a cutting edge 19.

The guide surface 10 is preferably provided as a cylinder jacket surface 10, where the axis 13 of this cylinder jacket surface is disposed outside of the jet nozzle body 2 and in a plane 14 with the axis 7 of the jet nozzle body 2 and the axis 13 is preferably inclined by an angle of from about 0.5 to 2.5 relative to this axis 7. The radius 17 of the cylinder jacket surface 10 can be from about 30 to 80 millimeters and is preferably from about 40 to 60 millimeters. The cutting edge 19 can be disposed in a plane 20 directed about vertical to the axes 6 of the nozzle channels 5. The projection of the cutting edge 19 in the direction of the axes 6 of the nozzle channels 5 can cut the nozzle channels 5. The ratio of the length 16 of the cylinder jacket surface 10 to the radius 17 of the cylinder jacket surface 10 can be between 40 and 60 millimeters.

The ratio of the axial distance 32 of the axes 6 of the two nozzle channels most remote from each other relative to the radius 17 of the cylinder jacket surface 10 can be in the region from 0.15 to 0.23. The end of the guide surface 10 furnishing the cutting edge opposite to the jet nozzle body in the direction of its axis 7 can be recessed by a distance 22 in the direction of its axis 7.

The jet nozzle 1 can be disposed parallel to the axes 31 of the rollers 23 and can be directed between the rollers 23 for cooling of guide and support rollers 23. The jet nozzle can be disposed at a distance above the strand surface, that is the tangential connection plane 25 of the jacket surfaces 26 of two rollers 23. The guide surface 10 is directed away from the connection plane 25 of the jacket surfaces 26 of two neighboring rollers 23, where the tangential lines 28 disposed in a plane vertical to the axes 31 of the rollers 23 and attached to the guide surface 10 are directed to the axes 31 of the rollers 23.

In the following the invention is illustrated based on the details of the Figs. The same numerals in different Figs. indicate corresponding items. The jet nozzle 1 is provided with a substantially cylindrical jet nozzle body 2, which is closed at the front by a front wall 3. A thread 4 is provided at the end of the cylindrical jet nozzle body 2 for connecting to a cooling agent pressure line.

Two parallel nozzle channels 5 are provided in the front wall 3, the axes 6 of which are located in a plane 8 running through the longitudinal axis 7 of the cylindrical jet nozzle body 2. The hydraulic diameter of the nozzle channels is from about 1.5 to 4 millimeters, where the hydraulic diameter is defined as the quotient of the fourfold cross-sectional area and the circumference of a nozzle channel. The hydraulic diameter is 2.5 millimeter in the embodiment illustrated. The nozzle channels are disposed in parallel to the axis 7.

The jet nozzle body 2 is provided with an extension 9 at the front face of the jet nozzle 1. A cylinder jacket surface 10 is incorporated at the front side of the extension 9. The nozzle channels 5 merge without steps into this cylinder jacket surface, this means that the intersection line 11 of the cylinder jacket surface 10 with the front face of the jet nozzle body provided with exit openings 12 of the nozzle channels and the exit openings are tangents to each other as can be recognized from FIG. 2. The axis 13 of the cylinder jacket surface is disposed in a plane 14 with the axis 7 of the jet nozzle body and is inclined with respect to the same, and in particular with an angle 15 ranging from about 0.5 to 5 degrees. The length of the cylinder jacket surface 10 amounts to 48 millimeters. It is preferably from 40 to 60 millimeters. The radius 17 of the cylinder jacket surface 10 is preferably from about 30 to 80 millimeters. In the embodiment illustrated the radius 17 amounts to 60 millimeters.

A break provision 18 for the exiting beam is provided at the end of the extension 9. The break provision 18 comprises a cutting edge 19, which is formed through the section of the cylinder jacket surface 10 with a plane 20 directed about vertically relative to the axis 7 of the jet nozzle body 2. In order to avoid a damaging of the cutting edge during assembly of the nozzle, the cutting edge 19 is recessed relative to the front face 21 of the extension by the distance 22.

As can be recognized from FIG. 3 the inclination of the axis 13 of the cylinder jacket surface 10, the nozzle channel diameter 5', the length 16 of the cylinder jacket surface 10 and its radius 17 are coordinated such that the nozzle channels 5 are intersected upon projection of the cutting edge 19 in the direction of the axes 6 of the nozzle channels 5 by the projection of the cutting edge 19, that is they are covered only in part by the cylinder jacket face 10 as seen in the direction of the axis of the jet nozzle. A part of the nozzle cross-section (compare FIG. 3) protrudes beyond the cylinder jacket face 10.

A jet nozzle 1 is shown in FIG. 4 in a representation analogous to that of FIG. 3, where this jet nozzle is incorporated between two neighboring strand guide rollers 23. It can be recognized that the jet nozzle 1 with its longitudinal axis 7 is provided at a distance 24 above the strand surface, that is at a distance above the connection plane 25 of the jacket faces 26 of two neighboring strand guiding rollers 23.

It is further shown in FIG. 4 that the tangents 28 applied to the cylinder jacket face 10 at its longitudinal edges 27 are directed towards the axes of the rollers. The cross-section 29 through the squirt of cooling agent shown in FIG. 4 exhibits a sickle shape at a distance from the break provision, which remains about equal over the full length of the strand guide rollers with respect to its width 30. As can be recognized from FIG. 4, the cooling agent jet touches the jacket faces 26 of the rollers 23, and in fact over their total length such that nearly the full amount of water is sprayed between the strand guide rollers without that the jacket faces 26 of the rollers are sprayed directly. Based on such a constructed cooling agent squirt it can effectively be prevented that a part of the same impinges on the roller surfaces, for example at their bearing positions, directed vertically with respect to the axes 31 of the rollers 23, as would be the case for a cooling agent squirt beam extending like a fan in the longitudinal direction of the cooling agent jet. Only a small part of the cooling agent exiting from a spray nozzle 1 serves for cooling of the rollers, in fact the fine dispersed cooling agent at the side edge regions of the cooling agent jet squirt. In this manner the amount of cooling agent flowing onto the slab can be decreased to about 30 percent of the total amount of cooling agent.

The cooling agent jet focussed from the cylinder jacket face 10 effectively shields the roller jacket face 26 from the radiation heat of the strand.

The invention is not limited to the example illustrated, but it can be modified in various ways. For example, it is possible to provide more than two nozzle channels 5, where then all nozzle channels pass without step into the cylinder jacket face, that is all nozzle channels tangent the section line of the cylinder jacket face 10 with the front face 3 of the jet nozzle body.

It is possible to vary the length 16 and the radius 17 of the cylinder jacket face 10 where the ratio of the length 16 of the guide face is to be between 40 and 60 millimeters. The ratio of the axial distance 32 of the axes 6 of the two nozzle channels disposed farthest apart to the radius 17 of the cylinder jacket face 10 is to be positioned in the area between 0.15 and 0.23 for achieving the focussing effect of the cylinder jacket face.

The cylinder face can be substituted by another face, for example by a face of parabolic, hyperbolic or elliptical or oval cross-sectional shape, where the guide surface is formed by a parallel shifting of the cross-section along the axis 13, that is along an axis inclined relatively to the axis of the jet nozzle body 2 and forming a plane with this axis. The essential point is the curvature cross to the axis of the jet nozzle body.

It will be understood that each of the elements described above, or two or more together, may also find a useful application in other types of cooling system configurations and liquid squirting procedures differing from the types described above.

While the invention has been illustrated and described as embodied in the context of a jet nozzle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cooling arrangement for the cooling of continuous casting plants with fluid jets comprising rollers forming part of a continuous casting plant for supporting cast material;

a jet nozzle body disposed adjacent to said rollers and having at least two nozzle channels disposed next to each other with parallel axes and the hydraulic diameter of the nozzle channels can range from about 1.5 to 4 millimeters;

a concave guide surface for guiding the jet exiting from the nozzle with the nozzles merging stepless into the guide surface and where the axes of the nozzle channels and the guide surface include an angle of from about 0.5 to 5 degrees and wherein the guide surface is formed as a cylinder jacket surface, where the axis of this cylindrer jacket surface is outside of the jet nozzle body and wherein the jet of cooling agent is directed substantially in parallel to a roller of the continuous casting plant for substantially sheilding the rollers from heat radiating off the cast material; and a break provision with a cutting edge disposed at the guide surface.

2. The cooling arrangement for the cooling of continuous casting plants with fluid jets according to claim 1 wherein the guide surface is disposed near a plane including the axis of the jet nozzle body.

3. The cooling arrangement for the cooling of continuous casting plants with fluid jets according to claim 2 wherein the guide surface includes an angle of from about 0.5 to 2.5 degrees with the axis of the jet nozzle body.

4. The cooling arrangement for the cooling of continuous casting plants with fluid jets according to claim 2 wherein the radius of the cylinder jacket surface is from about 30 to 80 millimeters.

5. The cooling arrangement for the cooling of continuous casting plants with fluid jets according to claim 1 wherein the cutting edge is disposed in a plane perpendicular to the axes of the nozzle channels.

6. The cooling arrangement for the cooling of continuous casting plants with fluid jets according to claim 1, further comprising a cutting edge disposed at the end of the jacket surface opposite the nozzles, wherein the cutting edge is disposed above a plane through the axes of the nozzle channels.

7. The cooling arrangement for the cooling of continuous casting plants with fluid jets according to claim 1 wherein the ratio of the length of the cylinder jacket surface to the radius of the cylinder jacket surface is in the range of from about 0.3 and 1.3, where the length of the cylinder jacket surface amounts to from about 40 to 60 millimeters.

8. The cooling arrangement for the cooling of continuous casting plants with fluid jet according to claim 1, wherein the nozzle channels are disposed at a distance and wherein the ratio of the distance between the axes of the two nozzle channels to the radius of the cylinder jacket surface is in the range of from about 0.15 to 0.23.

9. The cooling arrangement for the cooling of continuous casting plants with fluid jets according to claim 1 wherein the end of the guide plane providing the cutting edge is recessed relative to the jet nozzle body in the direction of its axis by a distance.

10. The cooling arrangement for the cooling of continuous casting plants with fluid jets according to claim 1 wherein the jet nozzle with its longitudinal axis is directed in parallel with the axes of the rollers and is further disposed at a distance above the cast material.

11. The cooling arrangement for the cooling of continuous casting plants with fluid jets according to claim 1 wherein the jet nozzle body is cylindrical and the diameter is from about 5 to 20 times the diameter of a nozzle.

12. The cooling arrangement for the cooling of continuous casting plants with fluid jets according to claim 1 wherein the jet nozzle body is cylindrical and the radius of the cylinder jacket surface is from about 5 to 20 times the radius of the jet nozzle body.

13. The jet nozzle for the cooling of continuous casting plants with fluid jets according to claim 1 wherein the jet nozzle body is cylindrical and the radius of the cylinder jacket surface is from about 5 to 20 times the radius of the jet nozzle body.

* * * * *